United States Patent [19]

Ödlund

[11] Patent Number: 4,806,067

[45] Date of Patent: Feb. 21, 1989

[54] UNIT, ATTACHABLE TO A LOADER

[76] Inventor: Björn A. I. Ödlund, Box 2025, 361 02 Emmaboda, Sweden

[21] Appl. No.: 177,883

[22] PCT Filed: Aug. 7, 1985

[86] PCT No.: PCT/SE85/00303

§ 371 Date: Apr. 24, 1986

§ 102(e) Date: Apr. 24, 1986

[87] PCT Pub. No.: WO86/01190

PCT Pub. Date: Feb. 27, 1986

Related U.S. Application Data

[63] Continuation of Ser. No. 852,957, Apr. 7, 1986, abandoned.

[30] Foreign Application Priority Data

Aug. 7, 1984 [SE] Sweden ..... 8403997

[51] Int. Cl.[4] ..... B66C 1/42

[52] U.S. Cl. ..... 414/734; 414/686; 414/718; 414/727; 414/728

[58] Field of Search ..... 414/718, 722, 734, 697, 414/686, 727, 694, 728, 703

[56] References Cited

U.S. PATENT DOCUMENTS

| | | | |
|---|---|---|---|
| 3,944,089 | 3/1976 | Polyanin et al. | 414/686 |
| 4,087,009 | 5/1978 | Profenna et al. | 414/686 |
| 4,134,507 | 1/1979 | Piercy et al. | 414/727 |
| 4,163,627 | 8/1979 | Schnittjer et al. | 414/686 |
| 4,210,219 | 7/1980 | Oswald et al. | 414/734 X |
| 4,353,424 | 10/1982 | Schenck et al. | 414/694 X |
| 4,382,743 | 5/1983 | Newell | 414/728 X |
| 4,405,281 | 9/1983 | Rüttershoff | 414/694 X |

FOREIGN PATENT DOCUMENTS

| | | | |
|---|---|---|---|
| 1010827 | 5/1977 | Canada | 414/734 |
| 3011206 | 10/1981 | Fed. Rep. of Germany . | |
| 3245489 | 6/1984 | Fed. Rep. of Germany . | |
| 2134266 | 12/1972 | France . | |
| 2289684 | 10/1974 | France | 414/697 |
| 2520715 | 8/1983 | France . | |
| 356489 | 5/1973 | Sweden . | |
| 409694 | 8/1979 | Sweden | 414/727 |

*Primary Examiner*—Frank E. Werner
*Assistant Examiner*—Donald W. Underwood
*Attorney, Agent, or Firm*—Burns, Doane, Swecker & Mathis

[57] ABSTRACT

An assembly capable of being fitted to a loader which is provided with an attachment device intended, for example, for co-operation with respective one ends of two lifting arms whose respective other ends are intended to support suitable load-handling devices, such as forks, buckets etc., and lifting-ram attachments intended, for example, to co-operate with respective first ends of two lifting rams whose respective other ends are capable of co-operating with the lifting arms. The assembly is provided at the central region thereof with a device for co-operating with the attachment device, and is provided in the upper part thereof with a pivotal attachment for pivotal co-operation with a part of a load-handling arrangement. The lower part of the assembly is arranged to extend towards the front wheels of the loader, and the lower part of the assembly is firmly connected to the lifting-ram attachments originally found on the loader.

8 Claims, 1 Drawing Sheet

UNIT, ATTACHABLE TO A LOADER

This application is as continuation of application Ser. No. 852,957, filed Apr. 7, 1986, now abandoned.

TECHNICAL FIELD

The present invention relates to an assembly capable of being attached to a loader and in particular to a loader which is originally equipped with attachment means intended for co-operation with a respective one end of two lifting arms whose other ends are intended to carry suitable load-handling devices, such as lifting forks, buckets etc., and where the lifting arms and load-handling devices are detached. In addition, the loader includes lifting ram attachments intended to co-operate with respective first ends of two lifting ram assemblies whose respective other ends coact with the lifting arms, and where the lifting rams are detached.

The invention is thus based on the concept of enabling a conventional loader retailed for service in one particular working area, e.g. as a sand loader, to be adapted with the aid of simple means for effective work in a completely different field, e.g. as a timber-bundle loader, by removing the bucket and associated lifting ram assemblies from the loader and substituting the same with an assembly which is adapted for loading work in the new field.

The invention also relates to one such assembly which is provided in the central region thereof with means for connecting the same to attachment means originally provided on the loader, and the other part of which presents a pivot attachment for pivotal co-action with a load-handling arrangement, normally an operating arm or jib arrangement.

BACKGROUND ART

There is known from Swedish Patent Application No. 7800001-5, published with serial number 409 694, a loader in the form of a two-part vehicle, whose forward part and associated wheels is journalled for rotation to the rear vehicle-part and its associated wheels. The rear vehicle part carries the machine motor etc., whereas the forward part of the vehicle carries the load-handling equipment of the machine, such as the loading or lifting assembly. According to the invention there is also connected to the forward part of the vehicle a main assembly which is mounted on a plurality of wheels which support against the ground or surface on which the vehicle stands and which are located forwardly of the axle of the front vehicle wheels, said main assembly carrying part of the load-handling equipment.

The main assembly illustrated here presumes that a unit provided with load-supporting wheels is connected to the axle-attachment of the forward part of the machine, or adjacent a part of said attachment, and to a further attachment means located over the axle-attachment placed on the forward part of the vehicle. The main assembly incorporates a hydraulic piston-cylinder device which is intended to power a lifting assembly and which extends between the axle-attachment of the assembly, or a part adjacent thereto, and a lifting arm forming part of the lifting assembly.

The pertinent prior art also includes the arrangement described and illustrated in Swedish Patent Application No. 14151/77, published with serial number 356 489. Described and illustrated in this publication is a loader which supports a lifting assembly which is controlled from a control seat located in the forward part of the tractor and which includes a raisable and lowerable lifting arm, the forward end of which carries a gripping assembly comprising gripping arms designed, for example, to grip and lift a bundle of elongated objects, such as logs. The lifting arms can be extended telescopically and are journalled for vertical movement on a journal shaft which extends substantially parallel with the control seat of the machine and above the same.

The arrangement illustrated and described in Canadian Patent Specification No. 1,010,827 also forms part of the pertinent prior art.

SUMMARY OF THE INVENTION

Technical Problem

With reference to the existing state of the prior art, particularly as expressed in the aforesaid publication 409 694, it is obvious that a serious technical problem is one of providing with the aid of simple means an assembly which can be attached to a loader with the aid of existing attachment means and lifting-ram attachments for suitable loading devices, so as to enable said assembly to be readily attached to the loader.

It will be seen that a further qualified technical problem in this regard is one of providing conditions which will enable the assembly to be made light in weight and any form of load-supporting wheels to be omitted, while providing nevertheless a stable and robust structure capable of withstanding and absorbing the extremely large forces to which the assembly and the loader are subjected when loading the load-handling equipment with weights of up to 30 tons.

Another technical problem is one of constructing, with the aforesaid conditions in mind, an assembly which can be readily fitted to the loader.

A further qualified technical problem is then one of enabling the assembly to be readily attached operatively to the loader, while still constructing the assembly for heavy loads.

Another technical problem is one of providing conditions which will enable an assembly capable of being fitted to a loader to be removed therefrom, and enable the assembly to be readily modified for an intended use within an initially intended field.

SOLUTION

The present invention thus relates to an assembly which can be fitted to a loader provided with attachment means for co-operation with a respective one end of two lifting arms whose respective other ends are intended to support suitable loading devices, such as lifting forks, buckets etc., and with lifting ram attachment intended for co-operation with a respective one end of two lifting rams whose other ends co-operate with the lifting arms, and where the assembly is provided in the central region thereof with means for co-operating with said attachment means and is further provided in the upper part thereof with pivotal attachment means for pivotal co-action with a part of a load-handling arrangement.

In accordance with the invention, the lower part of the assembly extends towards the standard front wheels of the loader and is firmly connected to the lifting ram attachment originally provided on the loader.

According to one embodiment, two elongated, fixed members extend between the lowermost part of the assembly and the lifting ram attachments. These members are pivotally connected at both ends thereof.

The invention also proposes that the lower part of the assembly incorporates a transverse beam having provided adjacent thereto attachments for one end of one or more piston-cylinder devices, the other end, or ends, of which act on an operating arm or jib forming part of a load-handling arrangement. The arm conveniently has a telescopic function.

The attachment intended for the one end of the piston-cylinder device acts at the center part of the arm. The arm is also preferably curved and the telescopic function thereof is placed in an upper arm portion.

In accordance with a further embodiment, the lower part of the assembly is located immediately above the front wheel axle.

The assembly preferably comprises two side members which are joined together in the upper assembly part and in the lower assembly part.

ADVANTAGES

Those advantages primarily associated with an assembly according to the invention capable of being fitted to a loader reside in the provision of conditions which enable the assembly to be readily fitted to an existing loader simply by utilizing attachment means and lifting-ram attachments already found on the loader and without removing the wheels of said loader.

The main characterizing features of an assembly according to the present invention capable of being fitted to a loader are set forth in the characterizing clause of the following claim 1.

BRIEF DESCRIPTION OF THE DRAWINGS

A preferred embodiment of an assembly capable of being fitted to a loader and constructed in accordance with the concept of the invention will now be described in more detail with reference to the accompanying drawing, in which.

DESCRIPTION OF AN EMBODIMENT AT PRESENT PREFERRED

Figure 1:
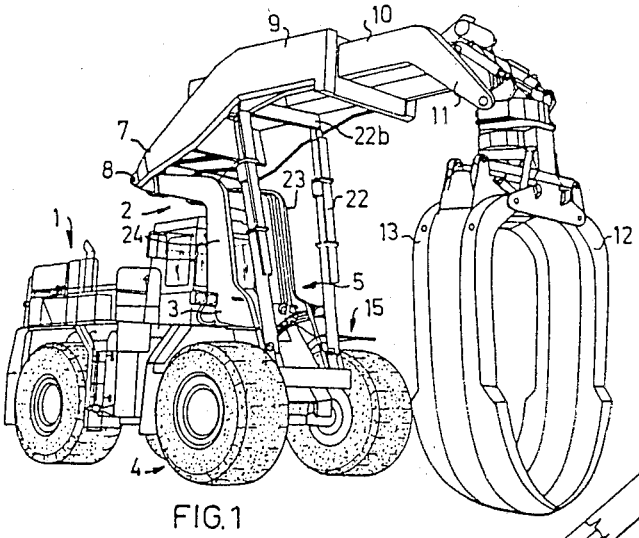
FIG. 1 illustrates a prior art loader fitted with an assembly constructed in accordance with the concept of the invention.
Figure 2:
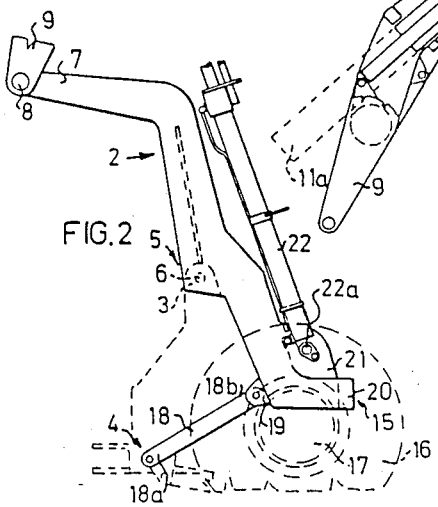
FIG. 2 is a side view of the assembly illustrated in FIG. 1, with the loader merely indicated in the figure.

FIG. 1 illustrates in perspective an assembly 2 which can be fitted to a loader 1. The loader is originally provided with an attachment means 3 intended for co-operation with respective one ends of two lifting arms, the respective other ends of which are intended to support suitable load-handling devices, such as loading forks, buckets, etc., and lifting-ram attachments 4 (c.f. FIG. 2) which are intended to co-operate with respective one ends of two piston rods, the other ends of which are co-operable with the lifting arms, the piston attached to said piston rods being arranged for movement in a respective lifting ram.

The basic concept of the invention resides in the detachment of the lifting arms, forks or buckets, and lifting rams with associated pistons, from the loader in the form of an assembly. The illustrated loader 1 is a wheel-mounted loader delivered by Caterpillar and retailed under the designation CAT 988B.

As will best be seen from FIG. 2, the assembly 2 is provided in the central region 5 thereof with means 6 for co-operation with the attachment means 3, and in the upper part 7 thereof with a pivotal attachment 8 for pivotal coaction with a part of a load-handling arrangement, which part has, in the illustrated embodiment, the form of one end of an operating arm or jib 9.

Figure 3:
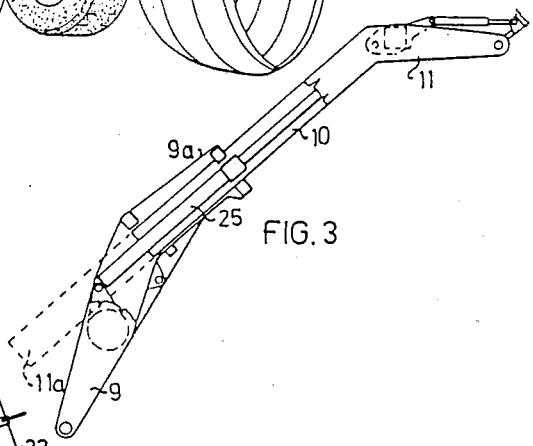
FIG. 3 illustrates a telescopic operating arm which is pivotally connected to the assembly, said arm being shown in its extended state.

As will best be seen from FIG. 3, the operating arm 9 co-operates with an elongated member 10, whose forwardly located end 11 carries means for holding two grippers 12,13 intended for on-loading and off-loading bundles of timber. The grippers 12 and 13 can be opened and closed by means not shown, and can be rotated or swung in a vertical plane, by means not shown.

It will be seen, however, that the lower part 15 of the assembly extends down to the front wheel 16 of the loader 1 and is, in particular, located above a center wheel axle 17.

The lower part 15 of the assembly is also firmly connected to the lifting ram attachments 4. Extending between the lower assembly part 15 and the two ram attachments 4 are two elongated stationary members 18, which are pivotally connected at one end **18*b* thereof to a respective ram attachment 4 and at the other end 18*b* thereof are pivotally connected to an attachment means 19 mounted on the lower assembly part 15. The lower assembly part 15 incorporates a transverse beam 20 adjacent which there are arranged attachments for one end 22*a* of one or more piston-cylinder devices 22, there being two such devices in the illustrated embodiment, the other end, or ends, 22*b* of which act upon the operating arm 9** forming part of a load-handling arrangement.

The arm 9 incorporates a telescopic action, the nature of which will not be described here. The attachment means intended for the said other end **22*b* of the piston-cylinder device 22 acts at the center part of the arm 9. The arm 9 is slightly curved and the telescopic action of the arm is restricted solely to the upper part 9*a* thereof, whereas the lower part 22*a* is arranged so as to be located immediately above the center axis 17 of the front wheels 16**.

FIG. 3 illustrates the part 10 in its extended state. Axial movement of the part 10 is effected with the aid of a piston-cylinder device 25. When the part 10 is fully withdrawn from its extended state, the rear part **11*a* will be located adjacent the attachment means 8**.

The assembly comprises mainly two side members 23,24 which are connected together at the bottom thereof through the beam 20 and at the top thereof through the upper part 7 of the assembly.

It will be understood that the invention is not restricted to the illustrated exemplifying embodiment, and that modifications can be made within the scope of the following claims.

I claim:

1. An assembly for attachment to a loader having front wheels, lower assembly attachment means and upper assembly attachment means, comprising:

a central region of the assembly having means for attaching the assembly to the upper assembly attachment means of the loader;

a pivotal attachment at the upper end of the assembly for attaching lifting arms that are intended to carry a load handling device;

a lower part of the assembly located above a central axis of the front wheels of the loader;

piston-cylinder devices attached to said assembly lower part for acting on said lifting arms attached to the pivotal attachment;

elongated fixed length members having first and second ends, the first end of each member being pivotally connected to one of the lower assembly attachment means for fixing the position of the assembly with respect to the loader; and attachment means mounted on the lower part of the assembly for pivotally connecting the second end of each of the elongated fixed length members to the lower part of the assembly.

2. The assembly according to claim 1, wherein the lower assembly part is provided with a transverse beam adjacent which there are located attachment means for one end of each of said piston-cylinder devices, the other ends of which act on the said lifting arms.

3. The assembly according to claim 2, wherein the said lifting arms incorporates a telescopic function.

4. The assembly according to claim 2, wherein attachment means for the said other end of the piston-cylinder devices are mounted the central part of each said lifting arm.

5. The assembly according to claim 4, wherein the said lifting arms are curved; and a telescopic function is embodied in an upper arm part of each said lifting arm.

6. The assembly according to claim 1, wherein two side members of the assembly are connected together at the lower assembly part and at the upper assembly part.

7. The assembly according to claim 3, wherein attachment means for the said other end of the piston-cylinder devices are mounted at the central part of each said lifting arm.

8. The assembly according to claim 7, wherein the said lifting arms are curved; and the telescopic function is embodied in an upper arm part of each said lifting arm.

* * * * *